US007630500B1

(12) United States Patent
Beckman et al.

(10) Patent No.: US 7,630,500 B1
(45) Date of Patent: Dec. 8, 2009

(54) SPATIAL DISASSEMBLY PROCESSOR

(75) Inventors: Paul E. Beckman, Cambridge, MA (US); Finn A. Arnold, Sutton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 08/228,125

(22) Filed: Apr. 15, 1994

(51) Int. Cl.
*H04R 5/00* (2006.01)

(52) U.S. Cl. ..... 381/18; 381/27

(58) Field of Classification Search ..... 381/1, 381/2, 17, 18, 19–23, 27; 375/122
See application file for complete search history.

(56) References Cited

U.S. PATENT DOCUMENTS 3,969,588 A * 7/1976 Raydon et al. ..... 381/24
5,109,417 A * 4/1992 Fielder et al. ..... 704/205
5,197,099 A * 3/1993 Hirasawa ..... 381/27
5,197,100 A * 3/1993 Shiraki ..... 381/27
5,265,166 A * 11/1993 Madnick et al. ..... 381/16
5,291,557 A * 3/1994 Davis et al. ..... 381/22
5,341,457 A * 8/1994 Hall, II et al. ..... 381/1
5,361,278 A * 11/1994 Vaupel et al. ..... 375/122
5,459,790 A * 10/1995 Scofield et al. ..... 381/1
5,497,425 A * 3/1996 Rapoport ..... 381/17
5,575,284 A * 11/1996 Athan et al. ..... 600/323
5,594,800 A * 1/1997 Gerzon ..... 381/18
5,671,287 A * 9/1997 Gerzon ..... 381/18

OTHER PUBLICATIONS

"SP-1 Spatial Sound Processor", Spatial Sound Inc., 1990.*

* cited by examiner

*Primary Examiner*—Ping Lee
(74) *Attorney, Agent, or Firm*—Fish & Richardson P.C.

(57) ABSTRACT

A method of disassembling a pair of input signals L(t) and R(t) to form subband representations of N output channel signals $o_1(t), o_2(t), \ldots, o_N(t)$, wherein t is time. The method includes the steps of generating a subband representation of the signal L(t) containing a plurality of subband components $L_k(t)$ where k is an integer ranging from 1 to M; generating a subband representation of the signal R(t) containing a plurality of subband components $R_k(t)$; and constructing the subband representation for each of the plurality of output channel signals, each of those subband representations containing a plurality of subband components $o_{j,k}(t)$, wherein $o_{j,k}(t)$ represents the $k^{th}$ subband of the $j^{th}$ output channel signal and is constructed by combining components of the input signals L(t) and R(t) according to an output construction rule: $o_{j,k}(t)=f(L_k(t),R_k(t))$ for k=1, 2, . . . , M and j=1, 2, . . . , N.

34 Claims, 3 Drawing Sheets

SPATIAL DISASSEMBLY PROCESSOR

BACKGROUND OF THE INVENTION

This invention relates to a method and apparatus for spatially disassembling signals, such as stereo audio signals, to produce additional signal channels.

In the field of audio, spatial disassembly is a technique by which the sound information in the two channels of a stereo signal are separated to produce additional channels while preserving the spatial distribution of information which was present in the original stereo signal. Many methods for performing spatial disassembly have been proposed in the past, and these methods can be categorized as being either linear or steered.

In a linear system, the output channels are formed by a linear weighted sum of phase shifted inputs. This process is known as dematrixing, and suffers from limited separation between the output channels. "Typically, each speaker signal has infinite separation from only one other speaker signal, but only 3 dB separation from the remaining speakers. This means that signals intended for one speaker can infiltrate the other speakers at only a 3 dB lower level." (quoted from Modern Audio Technology, Martin, Clifford, Prentice-Hall, Englewood Cliffs, N.J., 1992.) Examples of linear dematrixing systems include:

(a) Passive Dolby surround sound.

(b) "Optimum Reproduction Matrices for Multispeaker Stereo," Gerzon, Michael A., Journal of the Audio Engineering Society, Vol. 40, No. 7/8, July/August, 1992.

Steered systems improve upon the limited channel separation found in linear systems through directional enhancement. The input channels are monitored for signals with strong directionality, and these are then steered to only the appropriate speaker. For example, if a strong signal is sensed coming from the right side, it is sent to only the right speaker, while the remaining speakers are attenuated or turned off. At a high-level, a steered system can be thought of as an automatic balance and fade control which adjusts the audio image from left to right and front to back. The steered systems operate on audio at a macroscopic level. That is, the entire audio signal is steered, and thus in order to spatially separate sounds, they must be temporally separated as well. Steered systems are therefore incapable of simultaneously producing sound at several locations. Examples of steered systems include:

(a) Active Dolby surround sound.

(b) Julstrom, Stephen, "A High-Performance Surround Sound Process for Home Video", Journal of the Audio Engineering Society, Vol. 35, No. 7/8, July/August, 1987.

(c) U.S. Pat. No. 5,136,650, David H. Griesinger, Sound Reproduction.

In order for a spatial disassembly system to accurately position sounds, a model of the localization properties of the human auditory system must be used. Several models have been proposed. Notable ones are:

Makita, Y., "On the Directional Localization of Sound in the Stereophonic Sound Field," E.B.U. Rev., pt. A, no. 73, pp. 102-108, 1962.

M. A. Gerzon, "General Metatheory of Auditory Localisation," presented at the 1992 Convention of the Audio Engineering Society, May 1992.

No single mathematical model accurately describes localization over the entire hearing range. They all have shortcomings, and do not always predict the correct subjective localization of a sound. To improve the accuracy of models, separate models have been proposed for low frequency localization (below 250 Hz) and high frequency localization (above 1 kHz). In the range, 250-1000 Hz, a combination of models is applied.

Some spatial disassembly systems perform frequency dependent processing to more accurately model the localization properties of the human auditory system. That is, they split the frequency range into broad bands, typically 2 or 3, and apply different forms of processing in each band. These systems still rely on temporal separation in order to steer sounds to different spatial locations.

SUMMARY OF THE INVENTION

The present invention is a method for decomposing a stereo signal into N separate signals for playback over spatially distributed speakers. A distinguishing characteristic of this invention is that the input channels are split into a multitude of frequency components, and steering occurs on a frequency by frequency basis.

In general, in one aspect, the invention is a method of disassembling a pair of input signals L(t) and R(t) to form subband representations of N output channel signals $o_1(t)$, $o_2(t), \ldots, o_N(t)$. The method includes the steps of: generating a subband representation of the signal L(t) containing a plurality of subband components $L_k(t)$ where k is an integer ranging from 1 to M; generating a subband representation of the signal R(t) containing a plurality of subband components $R_k(t)$; and constructing the subband representation for each of the output channel signals, each of which representations contains a plurality of subband components $o_{j,k}(t)$, wherein $o_{j,k}(t)$ represents the $k^{th}$ subband of the $j^{th}$ output channel signal and is constructed by combining components of the input signals L(t) and R(t) according to an output construction rule $o_{j,k}(t)=f(L_k(t),R_k(t))$ for $k=1, 2, \ldots, M$ and $j=1, 2, \ldots, N$.

Preferred embodiments include the following features. The method also includes generating time-domain representations of the output channel signals, $o_1(t), o_2(t), \ldots, o_N(t)$, from their respective subband representations. Also, the construction rule is both output channel-specific and subband-specific, i.e., $o_{j,k}(t)=f_{j,k}(L_k(t),R_k(t))$ for $k=1, 2, \ldots, M$ and $j=1, 2, \ldots, N$. The method further includes the step of performing additional processing of one or more of the generated time-domain representations of the output channel signals, $o_1(t)$, $o_2(t), \ldots, o_N(t)$, e.g. recombining the N output channel signals to form 2 channel signals for playback over two loudspeakers or recombining the N output channels to form a single channel for playback over a single loudspeaker. The subband representations of the pair of input signals L(t) and R(t) are based on a short-term Fourier transform.

Also in preferred embodiments, the two input signals L(t) and R(t) represent left and right channels of a stereo audio signal and the output channel signals $o_1(t), o_2(t), \ldots, o_N(t)$ are to be reproduced over spatially separated loudspeakers. In such a system, the construction rule $f_{j,k}(\,)$ is defined such that when the output channels $o_1(t)$, $o_2(t)$, . . . , $o_N(t)$ are reproduced over N spatially separated loudspeakers, a perceived loudness of the $k^{th}$ subband of the output channel signals is the same as a perceived loudness of the $k^{th}$ subband of the left and right input channel signals when the left and right input channel signals are reproduced over a pair of spatially separated loudspeakers. More specifically, the construction rule $f_{j,k}(\,)$ is designed to achieve the following relationship for at least some of the k subbands:

$$|L_k(t)|^2 + |R_k(t)|^2 = \sum_{j=1}^{N} |o_{j,k}(t)|^2$$

or it is designed to achieve the following relationship for at least some of the k subbands:

$$|L_k(t)| + |R_k(t)| = \sum_{j=1}^{N} |o_{j,k}(t)|$$

Also, the construction rule $f_{j,k}(\,)$ is defined such that when the output channels $o_1(t), o_2(t), \ldots, o_N(t)$ are reproduced over N spatially separated loudspeakers, a perceived location of the $k^{th}$ subband of the output channel signals is the same as the localized direction of the $k^{th}$ subband of the left and right input channels when the left and right input channels are reproduced over a pair of spatially separated loudspeakers.

In general, in another aspect, the invention is a method of disassembling a pair of input signals L(t) and R(t) to form a subband representation of an output channel signal o(t). The method includes the steps of: generating a subband representation of the signal L(t) containing a plurality of subband components $L_k(t)$ where k is an integer ranging from 1 to M; generating a subband representation of the signal R(t) containing a plurality of subband components $R_k(t)$; and constructing the subband representation of the output channel signal o(t), which subband representation contains a plurality of subband components $o_k(t)$, each of which is constructed by combining corresponding subband components of the input signals L(t) and R(t) according to a construction rule $o_k(t)=f(L_k(t),R_k(t))$ for k=1, 2, . . . , M.

Among the principle advantages of the invention are the following.

(1) Sounds which temporally overlap may be steered to different locations if they occur in distinct frequency bands.

(2) The invention preserves the original spectral balance of the signal. That is, no spectral coloration occurs as a result of processing.

(3) The invention preserves the original spatial balance of the signal for a centrally located listener. That is, the perceived location of sounds is unchanged when reproduced using multiple output channels.

(4) The invention provides better image stability than conventional two speaker stereo, especially for noncentrally located listeners.

(5) Frequency dependent localization behavior of the human auditory system can be easily incorporated since signals are processed in narrow frequency bands.

Other advantages and features will become apparent from the following description of the preferred embodiment and from the claims.

DESCRIPTION OF THE PREFERRED EMBODIMENTS

Figure 1:
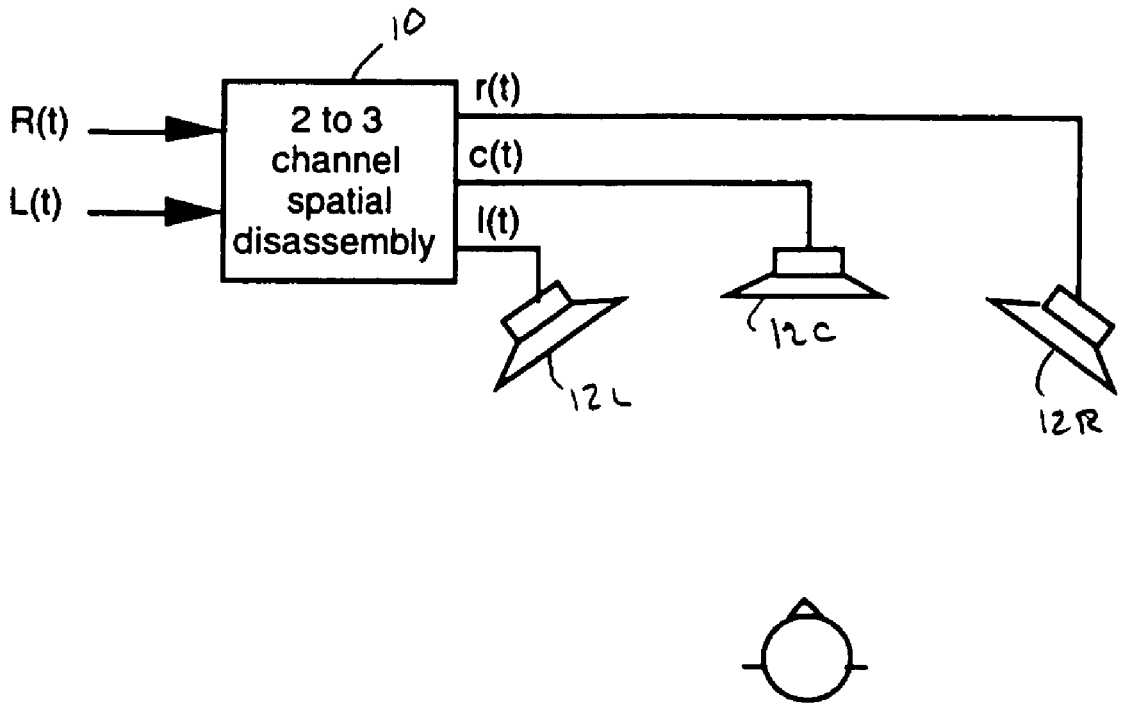
FIG. 1 illustrates positioning of loudspeakers when the input is disassembled into three output channels.

The described embodiment is of a 2 input-3 output spatial disassembly system. The stereo input signals L(t) and R(t) are processed by a 2 to 3 channel spatial disassembly processor 10 to yield three output signals l(t), c(t), and r(t) which are reproduced over three speakers 12L, 12C and 12R, as shown in FIG. 1. The center output speaker 12C is assumed to lie midway between the left and right output speakers.

The described embodiment employs a Short-Term Fourier Transform (STFT) in the analysis and synthesis steps of the algorithm. The STFT is a well-known digital signal processing technique for splitting signals into a multitude of frequency components in an efficient manner. (Allen, J. B., and Rabiner, L. R., "A Unified Approach to Short-Term Fourier Transform Analysis and Synthesis," Proc. IEEE, Vol. 65, pp. 1558-1564, November 1977.) The STFT operates on blocks of data, and each block is converted to a frequency domain representation using a fast Fourier transform (FFT).

Figure 2:
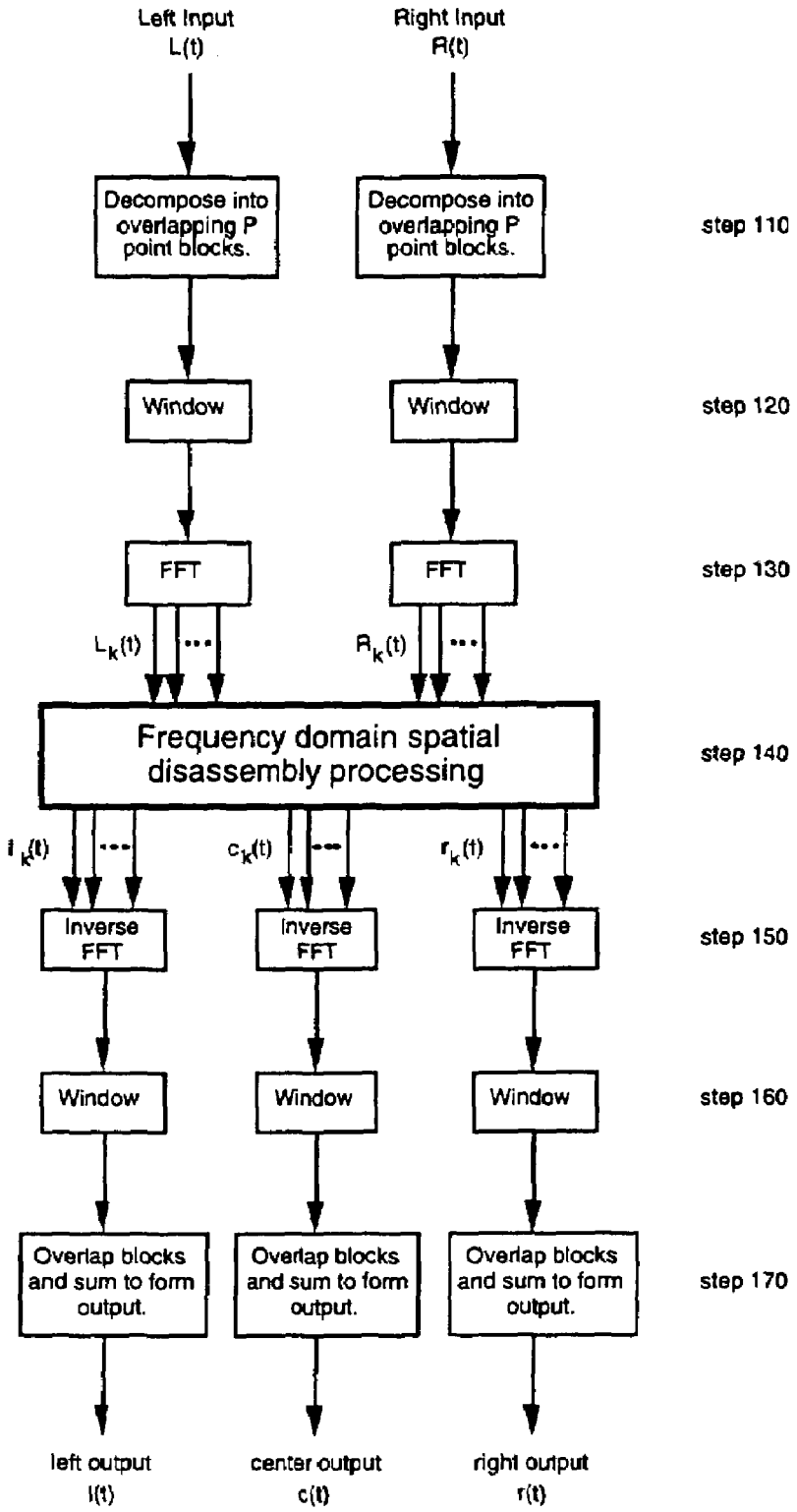
FIG. 2 is a flowchart of a 2 to 3 channel spatial disassembly algorithm which utilizes the short-term Fourier transform.

In general terms, a left input signal and right input signal, representing for example the two channels of a stereo signal, are each processed using a STFT technique as shown in FIG. 2. This yields signals $L_k(t)$ and $R_k(t)$ which equal the $k^{th}$ frequency coefficients of the left and right input channels for a block of data at time t. The frequency samples serve as subband representations of the input channels. These two signals are then processed in the frequency domain by a spatial disassembly processing algorithm 140 to produce signals $l_k(t)$, $c_k(t)$, and $r_k(t)$, representing the frequency coefficients of the left, center, and right output channels respectively. As with the input, the frequency samples $l_k(t)$, $c_k(t)$, and $r_k(t)$ serve as subband representations of the output channels. Each of these signals is then processed using an inverse STFT technique to produce time domain versions of the left, center, and right output signals.

The STFT processing of both the left input signal and the right input signal are identical. In this embodiment, the input signals are sampled representations of analog signals sampled at a rate of 44.1 kHz. The sample stream is decomposed into a sequence of overlapping blocks of P signal points each (step 110). Each of the blocks is then operated on by a window function which serves to reduce the artifacts that are produced by processing the signal on a block by block basis (step 120). The window operations of the described embodiment use a raised cosine function that is 1 block wide. The raised cosine is used because it has the property that when successively shifted by ½ block and then added, the result is unity, i.e., no time domain distortion or modulation is introduced. Other window functions with this perfect reconstruction property will also work.

Since the window function is performed twice, once during the STFT phase of processing and again during the inverse STFT phase of processing, the window used was chosen to be the square root of a raised cosine window. That way, it could be applied twice, without distorting the signal. The square root of a raised cosine equals half a period of a sine wave.

STFT algorithms vary in the amount of block overlap and in the specific input and output windows chosen. Traditionally, each block overlaps its neighboring blocks by a factor of ¾ (i.e., each input point is included in 4 blocks), and the windows are chosen to trade-off between frequency resolution and adjacent subband suppression. Most algorithms function properly with many different block sizes, overlap factors, and choices of windows. In the described embodiment, P equals 2048 samples, and each block overlaps the previous block by ½. That is, the last 1024 samples of any given block are also the first 1024 samples of the next block.

The windowed signal is zero padded by adding 2048 points of zero value to the right side of the signal before further processing. The zero padding improves the frequency resolution of the subsequent Fourier transform. That is, rather than producing 2048 frequency samples from the transform, we now obtain 4096 samples.

The zero padded signal is then processed using a Fast Fourier Transform (FFT) technique (step 130) to produce a set of 4096 FFT coefficients—$L_k(t)$ for the left channel and $R_k(t)$ for the right channel.

A spatial disassembly processing (SDP) algorithm operates on the frequency domain signals $L_k(t)$ and $R_k(t)$. The algorithm operates on a frequency by frequency basis and individually determines which output channel or channels should be used to reproduce each frequency component. Both magnitude and phase information are used in making decisions. The algorithm constructs three channels: $l_k(t)$, $c_k(t)$, and $r_k(t)$, which are the frequency representations of the left, center, and right output channels respectively. The details of the SDP algorithm are presented below.

After generating the frequency coefficients $l_k(t)$, $c_k(t)$, and $r_k(t)$, each of the sequences is transformed back to the time domain to produce time sampled sequences. First, each set of frequency coefficients is processed using the inverse FFT (step 150). Then, the window function is applied to the resulting time sampled sequences to produce blocks of time sampled signals (step 160). Since the blocks of time samples represent overlapping portions of the time domain signals, they are overlapped and summed to generate the left output, center output, and right output signals (step 170).

Frequency Domain Spatial Disassembly Processing

The frequency domain spatial disassembly processing (SDP) algorithm is responsible for steering the energy in the input signal to the appropriate output channel or channels. Before describing the particular algorithm that is employed in the described embodiment, the rules that were applied to derive the algorithm will first be presented.

The rules are stated in terms of psychoacoustical affects that one wishes to create. Two main rules were applied:

(1) The spectral balance of the input signals should be preserved when played out over multiple output speakers. That is, there can be no spectral coloration due to processing.

(2) The spatial balance of the input signals should be preserved when played out over multiple output speakers. That is, if a signal is localized at θ degrees when played back over 2 speakers, it must again be localized at θ degrees when played back over multiple speakers (this assumes that the listener is located in the center between the left and right output speakers).

An important component of our approach is that these rules are applied in each subband, that is, on a frequency by frequency basis.

The spectral and spatial balance properties are stated in terms of desired psychoacoustical affects, and must be approximated mathematically. As stated earlier, many mathematical models of localization exist, and the resulting SDP algorithm is dependent upon the model chosen.

The spectral balance property was approximated by requiring an energy balance between the input and output channels $$|L_k(t)|^2+|R_k(t)|^2=|l_k(t)|^2+|c_k(t)|^2+|r_k(t)|^2 \quad (1)$$

This states that the net input energy in subband k must equal the net output energy in subband k.

Psychoacoustically, this is correct for high frequencies; those above 1 kHz. For low frequencies, those below 250 Hz, the signals add in magnitude and a slightly different condition holds $$|L_k(t)|+|R_k(t)|=|l_k(t)|+|c_k(t)|+|r_k(t)| \quad (2)$$

For signals in the range 250 Hz to 1 kHz, some combination of these conditions holds. For the described implementation, it was assumed that energy balance should be maintained over the entire frequency range. This leads to a maximum error of 3 dB at low frequencies, and this can be compensated for by a fixed equalizer which boosts low frequencies. Although not a perfect compensation, it is sufficient.

The spatial balance property was approximated through a heuristic approach which has its roots in Makita's theory of localization. First, a spatial center is computed for each subband. Psychoacoustically, the spatial center is the perceived location of the sound due to the differing magnitudes of the left and right subbands. It is a point somewhere between the left and right speaker. The location of the left speaker is labeled −1 and the location of the right speaker labeled +1. (The absolute units used is unimportant.) The spatial center of the $k^{th}$ subband at time t is computed as $$\Lambda = \frac{|R_k(t)|^2 - |L_k(t)|^2}{|R_k(t)|^2 + |L_k(t)|^2} \quad (3)$$

This works as expected. When there is no left input channel, then Λ=1 and sound would be localized as coming from the right speaker. When there is no right input channel, then Λ=−1 and sound would be localized as coming from the left speaker. When the input channels are of equal energy, $|L_k(t)|^2=|R_k(t)|^2$, then Λ=0 and sound would be localized as coming from the center. This definition of the spatial center does not take phase information into account. We include the effects of phase differences by the manner in which the center subband $c_k(t)$ is constructed. This will become apparent later on.

The spatial center of the output is defined in terms of the three output channels and is given by $$\lambda = \frac{|r_k(t)|^2 - |l_k(t)|^2}{|l_k(t)|^2 + |c_k(t)|^2 + |r_k(t)|^2} \quad (4)$$

In order for there to be spatial balance between the input and output channels, we require that Λ=λ. Using this fact, equation (4) can be we written in terms of Λ, $$\Lambda|l_k(t)|^2+\Lambda|c_k(t)|^2+\Lambda|r_k(t)|^2=|r_k(t)|^2-|l_k(t)|^2 \quad (5)$$

$$(\Lambda+1)|l_k(t)|^2+\Lambda|c_k(t)|^2+(\Lambda-1)|r_k(t)|^2=0 \quad (6)$$

Solution to Spectral and Spatial Balance Equations

Together, equations (1) and (6) place two constraints on the three output channels. Additional insight can be gained by writing them in matrix form $$\begin{bmatrix} 1 & 1 & 1 \\ (1+\Lambda) & \Lambda & (\Lambda-1) \end{bmatrix} \begin{bmatrix} |l_k(t)|^2 \\ |c_k(t)|^2 \\ |r_k(t)|^2 \end{bmatrix} = \begin{bmatrix} |L_k(t)|^2 + |R_k(t)|^2 \\ 0 \end{bmatrix} \tag{7}$$

where $\Lambda$ is given in (3).

Note that the equations only constrain the magnitude of the output signals but are independent of phase. Thus, the phase of the output signals can be arbitrarily chosen and still satisfy these equations. Also, note that there are a total of three unknowns, $|l_k(t)|$, $|c_k(t)|$, and $|r_k(t)|$, but only 2 equations. Thus, there is no unique solution for the output channels, but rather a whole family of solutions resulting from the additional degree of freedom:

$$\begin{bmatrix} |l_k(t)|^2 \\ |c_k(t)|^2 \\ |r_k(t)|^2 \end{bmatrix} = \begin{bmatrix} |L_k(t)|^2 \\ 0 \\ |R_k(t)|^2 \end{bmatrix} + \beta \begin{bmatrix} -1 \\ 2 \\ -1 \end{bmatrix} \tag{8}$$

where $\beta$ is a real number.

An intuitive explanation exists for this equation. Given some pair of input signals, one can always take some amount of energy $\beta$ from both the left and right channels, add the energies together to yield $2\beta$, and then place this in the center. Both the spectral and spatial constraints will be satisfied. The quantity $\beta$ can be interpreted as a blend factor which smoothly varies between unprocessed stereo ($l_k(t)=L_k(t)$, $c_k(t)=0$, $r_k(t)=R_k(t)$) and full processing ($c_k(t)$ and $r_k(t)$ but no $l_k(t)$ in the case of a right dominant signal). Since all of the signal energies must be non-negative, $\beta$ is constrained to lie in the range $0 \leqq \beta \leqq |w_k(t)|^2$ where $w_k(t)$ denotes the weaker channel $$\text{if } |L_k(t)| \leqq |R_k(t)| \text{ then } w_k(t)=L_k(t)$$

$$\text{if } |L_k(t)| > |R_k(t)| \text{ then } w_k(t)=R_k(t)$$

Output Phase Selection

As mentioned earlier, the spectral and spatial balances are independent of phase. The phase of the left and right output channels must be chosen so as not to produce any audible distortion. It is assumed that the left and right outputs are formed by zero phase filtering the left and right inputs $$l_k(t)=a_k L_k(t) \tag{9a}$$

$$r_k(t)=b_k R_k(t) \tag{9b}$$

where $a_k$ and $b_k$ are positive real numbers chosen to satisfy the spectral and spatial balance equations. Since $a_k$ and $b_k$ are positive real numbers, the phases of the output signals are unchanged from those of the input signals $$\angle l_k(t)=\angle L_k(t)$$

$$\angle r_k(t)=\angle R_k(t)$$

It has been found that setting the phase in this manner does not distort the left and right output channels.

Assume that the center channel $c_k(t)$ has been computed by some means. Then combining (7) and (9) we can solve for the $a_k$ and $b_k$ coefficients. This yields $$a_k = \sqrt{1 - \frac{|C_k(t)|^2}{2|L_k(t)|^2}} \tag{10a}$$

$$b_k = \sqrt{1 - \frac{|C_k(t)]|^2}{2|R_k(t)|^2}} \tag{10b}$$

Thus, once the center channel has been computed, the left and right output channels which satisfy both the spectral and spatial balance conditions can be determined.

Center Channel Construction

The only item remaining is to determine the center channel. There is no exact solution to this problem but rather a few guiding principles which can be applied. In fact, experience indicates that several possible center channels yield comparable results. The main principles which were considered are the following:

(1) The magnitude of the center channel should be proportional to the magnitude of the weaker input channel.

(2) The magnitude of the center channel should be inversely proportional to the phase difference between input signals. When the signals are in phase, the center channel should be strong; when out of phase, the center channel should be weak.

(3) The magnitude of the center channel must be such that the constraint on the allowable range of blend factors $\beta$ is observed.

(4) The center channel should reach an absolute maximum magnitude of $(2)^{1/2}|L_k(t)|$ when $L_k(t)$ and $R_k(t)$ are in phase and of equal magnitude.

The following two methods for deriving the center channel were found to yield acoustically acceptable results. They are of comparable quality.

$$\text{Method I } c_k(t) = \beta\left(\frac{2\sqrt{2}\,|w_k|}{|L_k(t)| + |R_k(t)|}\right)\left(\frac{L_k(t) + R_k(t)}{2}\right) \tag{11}$$

$$\text{Method II } c_k(t) = \sqrt{2}\,\beta\left(\frac{w_k + \frac{|w_k|}{|s_k|}s_k}{2}\right) \tag{12}$$

where $w_k$ and $s_k$ denote the weaker and stronger input channels, respectively.

$$\text{If } |L_k(t)| \leqq |R_k(t)| \text{ then } w_k=L_k(t) \text{ and } s_k=R_k(t)$$

$$\text{If } |L_k(t) > |R_k(t)| \text{ then } w_k=R_k(t) \text{ and } s_k=L_k(t)$$

In both cases $\beta$ serves a blend factor which determines the relative magnitude of the center channel. It has the same function as in (8), but a slightly different definition. Now $\beta$ is constrained to be between 0 and 1. Although not specifically indicated in the above equations, $\beta$ is a frequency dependent parameter. At low frequencies (below 250 Hz), $\beta$ and no processing occurs. At high frequencies (above 1 kHz), $\beta$ is a constant B. Between 250 Hz and 1 kHz, $\beta$ increases linearly from 0 to B. The constant B controls the overall gain of the center channel.

Method I can be thought of as applying a zero phase filter to the monaural signal $$\left(\frac{L_k(t)+R_k(t)}{2}\right) \tag{13}$$

Thus, if this method is used, the entire spatial disassembly algorithm reduces to a total of 3 time varying FIR digital filters. The collection of $a_k$ coefficients filters the left input signal to yield the left output signal; the $b_k$ coefficients filter the right input signal to yield the right output signal; and $$\beta\left(\frac{2\sqrt{2}\,|w_k|}{|L_k(t)|+|R_k(t)|}\right) \tag{14}$$

filters the monaural signal.

Method II can be best understood by analyzing the quantity $$\frac{|w_k|}{|s_k|}s_k.$$

This is a vector with the same magnitude as $w_k$ but with its angle determined by $s_k$. Averaging $w_k$ and $$\frac{|w_k|}{|s_k|}s_k$$

yields a vector whose magnitude is proportional to the weaker channel. Also, the center channel is large when $L_k(t)$ and $R_k(t)$ are in phase and small when they are out of phase. The additional factor of $(2)^{1/2}$ ensures that the signals add in energy when they are in phase. Method II has the advantage that out of phase input signals always yield no center channel, independent of their relative magnitudes.

Algorithm Summary

This section summarizes the mathematical steps in the steering portion of the two to three channel spatial disassembly algorithm. For each subband k of the current block perform the following operations:

1) Compute the center channel using either $$\text{Method I } c_k(t)=\beta\left(\frac{2\sqrt{2}\,|w_k|}{|L_k(t)|+|R_k(t)|}\right)\left(\frac{L_k(t)+R_k(t)}{2}\right) \tag{15}$$

$$\text{Method II } c_k(t)=\sqrt{2}\,\beta\left(\frac{w_k+\frac{|w_k|}{|s_k|}s_k}{2}\right) \tag{16}$$

where $w_k$ and $s_k$ denote the weaker and stronger input channels, respectively.

If $|L_k(t)|\leq|R_k(t)|$ then $w_k=L_k(t)$ and $s_k=R_k(t)$

If $|L_k(t)|>|R_k(t)|$ then $w_k=R_k(t)$ and $s_k=L_k(t)$ and β is a frequency dependent blend factor.

2) Using $c_k(t)$, compute the left and right output channels:

$$l_k(t)=L_k(t)\sqrt{1-\frac{|c_k(t)|^2}{2|L_k(t)|^2}} \tag{17a}$$

$$r_k(t)=R_k(t)\sqrt{1-\frac{|c_k(t)|^2}{2|R_k(t)|^2}} \tag{17b}$$

An 2-to-N Channel Embodiment

A high-level diagram of a 2-to-N channel system is shown in FIG. 1. The input to the system is a stereo signal consisting of left and right channels L(t) and R(t), respectively. These are processed to yield N output signals $o_1(t), o_2(t), \ldots, o_N(t)$. Three basic phases of processing are involved in the spatial disassembly process: namely, an analysis phase 200, a steering phase, and a synthesis phase 210.

During the analysis phase of processing, analysis systems 230, one for each input signal, decompose both L(t) and R(t) into M frequency components using a set of bandpass filters. L(t) is split into $L_1(t), L_2(t), \ldots, L_M(t)$. R(t) is split into $R_1(t), R_2(t), \ldots, R_M(t)$. The components $L_k(t)$ and $R_k(t)$ are referred to as subbands and they form a subband representation of the input signals L(t) and R(t).

Figure 3:
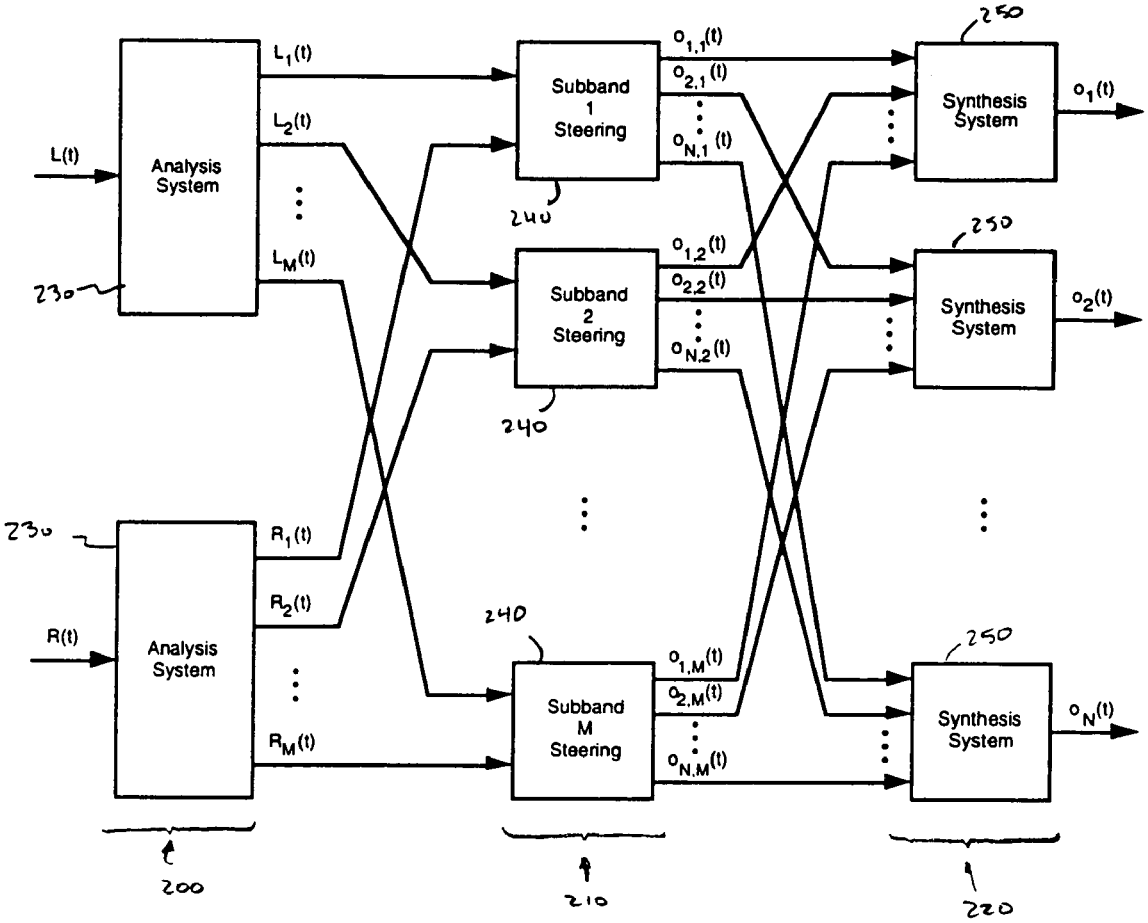
FIG. 3 is a high-level flowchart of the 2 to N channel spatial disassembly process.

During the subsequent steering phase, a subband steering module 240 for each subband generates the subband components for each of the output signals as illustrated in FIG. 3. Note that $o_{j,k}(t)$ denotes the $k^{th}$ subband of the $j^{th}$ output channel. The collection of signals $o_{j,1}(t), o_{j,2}(t), \ldots, o_{j,M}(t)$ forms a subband representation of the $j^{th}$ output channel, and this representation is based upon the same set of bandpass filters used in the analysis step. The steering modules analyze the spatial distribution of energy in the input signals on a subband by subband basis. Then, they distribute the energy to the same subband of the appropriate output channel or channels. That is, for each subband k, the corresponding subband steering module computes the contribution of $L_k(t)$ and $R_k(t)$ to $o_{1,k}(t)\ o_{2,k}(t), \ldots, o_{N,k}(t) \ldots$.

During the synthesis phase step, synthesis systems 250 synthesize the output channels $o_1(t), o_2(t), \ldots, o_N(t)$ from their respective subband representations.

If it is assumed that the left and right signals are played through left and right speakers located at distances $d_L$ and $d_R$, respectively, from a defined physical center location, then the psychoacoustical location for the $k^{th}$ subband (defined as the location from which the sound appears to be coming) is:

$$\Lambda=\frac{d_L|L_k(t)|^2+d_R|R_k(t)|^2}{|L_k(t)|^2+|R_k(t)|^2}$$

where distance to the left are negative and distances to the right are positive.

If the signal for the $k^{th}$ subband is disassembled for N speakers, each located a distance $d_j$ from the physical center, then to preserve the psychoacoustical location for that $k^{th}$ subband in the N speaker system the following condition must be satisfied for high frequencies:

$$\sum_{j=1}^{N}(\Lambda-d_j)|o_{j,k}(t)|^2=0$$

For low frequencies, a slightly different condition is imposed:

$$\sum_{j=1}^{N} (\Lambda - d_j)|o_{j,k}(t)| = 0.$$

Alternative Embodiments

As noted above, a distinguishing characteristic of this invention is that the input channels are split into a multitude of frequency components, and steering occurs on a frequency by frequency basis. The described embodiment represents one illustrative approach to accomplishing this. However, many other embodiments fall within the scope of the invention. For example, (1) the analysis and synthesis steps of the algorithm can be modified to yield a different subband representation of input and output signals and/or (2) the subband-level steering algorithm can be modified to yield different audible effects.

Variations of the Analysis/Synthesis Steps

There are a large number of variables that are specified in the described embodiment (e.g. block sizes, overlap factors, windows, sampling rates, etc.). Many of these can be altered without greatly impacting system performance. In addition, rather than using the FFT, other time-to-frequency transformations may be used. For example, cosine or Hartley transforms may be able to reduce the amount of computation over the FFT, while still achieving the same audible effect.

Similarly, other subband representations may be used as alternatives to the block-based STFT processing of the described embodiment. They include:

(1) The subband decomposition could be performed entirely in the time domain using an array of bandpass filters. A time-domain steering algorithm would be applied and the output channels synthesized in the time domain.

(2) A wavelet (or filterbank) decomposition could be used in which the subbands have variable bandwidth. This is an advantage because human hearing tends to be more discriminating of differences in frequency at lower frequencies than at higher frequencies. Thus, in making the spatial disassembly decisions it makes sense to sample more frequently at the lower frequencies than at the higher frequencies. Fewer subbands would be required in this type of decomposition and thus fewer steering decisions would have to be made. This would reduce the total computation burden of the algorithm.

Variations on the Steering Algorithm

The frequency domain steering algorithm is a direct result of the particular subband decomposition employed and of the audible effects which were approximated. Many alternatives are possible. For example, at low frequencies, the spatial and spectral balance properties can be stated in terms of the magnitudes of the input signals rather than in terms of their squared magnitudes. In addition, a different steering algorithm can be applied in each subband to better match the frequency dependent localization properties of the human hearing system.

The steering algorithm can also be generalized to the case of an arbitrary number of outputs. The multi-output steering function would operate by determining the spatial center of each subband and then steering the subband signal to the appropriate output channel or channels. Extensions to non-uniformly spaced output speakers are also possible.

Other Applications of Spatial Disassembly Processing

The ability to decompose an audio signal into several spatially distinct components makes possible a whole new domain of processing signals based upon spatial differences. That is, components of a signal can be processed differently depending upon their spatial location. This has shown to yield audible improvements.

Increased Spaciousness

The processed left and right output channels can be delayed relative to the center channel. A delay of between 5 and 10 milliseconds effectively widens the sound stage of the reproduced sound and yields an overall improvement in spaciousness.

Surround Channel Recovery

In the Dolby surround sound encoding format, surround information (to be reproduced over rear loudspeakers) is encoded as an out-of-phase signal in the left and right input channels. A simple modification to the SDP method can extract the surround information on a frequency by frequency basis. Both center channel extraction techniques shown in (15) and (16) are based upon a sum of input channels. This serves to enhance in-phase information. We can extract the surround information in a similar manner by forming a difference of input channels. Two possible surround decoding methods are:

$$\text{Method I } s_k(t) = \beta\left(\frac{2\sqrt{2}\,|w_k|}{|L_k(t)| + |R_k(t)|}\right)\left(\frac{L_k(t) + R_k(t)}{2}\right) \tag{18}$$

$$\text{Method II } s_k(t) = \sqrt{2}\,\beta\left(\frac{w_k - \frac{|w_k|}{|s_k|}s_k}{2}\right) \tag{19}$$

where $w_k$ and $s_k$ denote the weaker and stronger input channels, respectively.

If $|L_k(t)| \leqq |R_k(t)|$ then $w_k = L_k(t)$ and $s_k = R_k(t)$

If $|L_k(t)| > |R_k(t)|$ then $w_k = R_k(t)$ and $s_k = L_k(t)$ and β is a frequency dependent blend factor.

Enhanced Two-Speaker Stereo

A different application of spatial signal processing is to improve the reproduction of sound in a 2 speaker system. The original stereo audio signal would first be decomposed into N spatial channels. Next, signal processing would be applied to each channel. Finally, a two channel output would be synthesized from the N spatial channels.

For example, stereo input signals can be disassembled into a left, center, and right channel representation. The left and right channels delayed relative to the center channel, and the 3 channels recombined to construct a 2 channel output. The 2 channel output will have a larger sound stage than the original 2 channel input.

Reverberation Suppression

Some hearing impaired individuals have difficulty hearing in reverberent environments. SDP may be used to solve this problem. The center channel contains the highly correlated information that is present in both left and right channels. The uncorrelated information, such as echoes, are eliminated from the center channel. Thus, the extracted center channel information can be used to improve the quality of the sound signal that is presented to the ears. One possibility is to present only the center channel to both ears. Another possibility is to add the center channel information at an increased level to the left and right channels (i.e., to boost the correlated signal in the left and right channels) and then present these signals to the left and right ears. This preserves some spatial aspects of binaural hearing.

AM Interference Suppression

An application of SDP exists in the demodulation of AM signals. In this case, the left and right signals correspond to the left and right sidebands of an AM signal. Ideally, the information in both sidebands should be identical. However, because of noise and imperfections in the transmission channel, this is often not the case. The noise and signal degradation does not have the same effect on both sidebands. Thus, it is possible using the above described technique to extract the correlated signal from the left and right sidebands thereby significantly reducing the noise and improving the quality of the received signal.

What is claimed is:

1. A method of processing a pair of input signals L(t) and R(t) representing left and right channels of a stereo audio signal, characterized by a predetermined spectral balance and predetermined spatial balance to form subband signals representative of N output channel signals $o_1(t), o_2(t), \ldots, o_n(t)$, wherein N>2 and t is time, the output channel signals to be reproduced over spatially separated loudspeakers, said method comprising:

generating a first subband signal representation of the signal L(t), said first subband signal representation containing a plurality of first subband frequency sample components $L_k(t)$ where k is an integer ranging from 1 to M;

generating a second subband signal representation of the signal R(t), said second subband signal representation containing a plurality of second subband frequency sample components $R_k(t)$; and combining said frequency sample components of the input signals L(t) and R(t) according to an output construction rule $o_{j,k}(t)=f(L_k(t),R_k(t))$ for k=1, 2, . . . , M and j=1, 2, . . . , N to provide the output subband signal representation for each of said plurality of output channel signals, each of said output subband signal representations containing a plurality of output subband signal components $o_{j,k}(t)$, wherein $o_{j,k}(t)$ represents the $k^{th}$ subband output signal component of the $j^{th}$ output channel signal, wherein the output construction rule establishes the following relationship for at least some of the subband signal components $L_k(t)$ and $R_k(t)$ and output subband signal components $o_{j,k}(t)$ $$|L_k(t)| + |R_k(t)| = \sum_{j=1}^{N} |o_{j,k}(t)|$$

and reproducing the N output channel signals with N output speakers while preserving said predetermined spectral balance and said predetermined spatial balance of said input signals.

2. The method of claim 1 further comprising generating time-domain signals representative of the output channel signals, $o_1(t), o_2(t), \ldots, o_n(t)$, from their respective output subband signal representations.

3. The method of claim 1 wherein the output construction rule is subband specific, i.e., $o_{j,k}(t)=f_j(L_k(t),R_k(t))$ for k=1, 2, . . . , M and j=1, 2, . . . , N.

4. The method of claim 2 further comprising additionally processing one or more of the time-domain signals.

5. The method of claim 4 wherein the step of additionally processing comprises combining the N output channel signals to form two channel signals for playback over two loudspeakers.

6. The method of claim 4 wherein the step of additionally processing comprises combining the N output channel signals to form a single channel signal for playback over a single loudspeaker.

7. The method of claim 3 wherein the construction rule is also output channel-specific, i.e., $o_{j,k}(t)=f_{j,k}(L_k(t),R_k(t))$ for k=1, 2, . . . , M and j=1, 2, . . . , N.

8. The method of claim 1 wherein the output construction rule is further defined such that when the output channel signals $o_1(t), o_2(t), \ldots, o_n(t)$ are reproduced over N spatially separated loudspeakers, a perceived loudness of the kth subband signal component of the output channel signals is the same as a perceived loudness of the $k^{th}$ subband signal representations of the left and right input channel signals L(t) and R(t) respectively when the left and right input channel signals are reproduced over a pair of spatially separated loudspeakers.

9. The method of claim 1 wherein the output construction rule also establishes the following relationship for at least some of the subband signal components $L_k(t)$ and $R_k(t)$ and output subband signal components $o_{j,k}(t)$:

$$|L_k(t)|^2 + |R_k(t)|^2 = \sum_{j=1}^{N} |o_{j,k}(t)|^2.$$

10. The method of claim 1 wherein the output construction rule is further defined such that when the output channel signals $o_1(t), o_2(t), \ldots, o_n(t)$ are reproduced over N spatially separated loudspeakers, a perceived location of the kth subband output signal component of the output channel signals is the same as the localized direction of the kth subband signal representation of the left and right input signals L(t) and R(t) respectively when the left and right input signals L(t) and R(t) respectively are reproduced over a pair of spatially separated loudspeakers.

11. The method of claim 1 wherein the pair of input signals L(t) and R(t) are processed in accordance with a short-term Fourier transform to provide said first and second subband signal representations.

12. The method of claim 1 wherein the pair of input signals L(t) and R(t) are processed in accordance with a discrete cosine transform to provide said first and second subband signal representations.

13. The method of claim 1 wherein the pair of input signals L(t) and R(t) are processed in accordance with a Hartley transform to provide said first and second subband signal representations.

14. The method of claim 1 wherein the input signals L(t) and R(t) are processed with an array of bandpass filters to provide said first and second subband signal representations.

15. The method of claim 1 wherein the input signals L(t) and R(t) are processed in accordance with a wavelet decomposition.

16. The method of claim 1 wherein the input signals L(t) and R(t) are processed in accordance with a filterbank decomposition to provide said first and second subband signal representations.

17. The method of claim 1 wherein the step of processing of the L(t) input signal comprises:

sampling the L(t) input signal to provide a sequence of L(t) input signal samples;

grouping the latter samples into overlapping blocks;

applying a window function signal to each of said overlapping blocks to provide a corresponding plurality of windowed blocks; and processing each windowed block in accordance with a fast Fourier transform to provide the first subband signal representation of the L(t) input signal.

18. The method of claim 17 wherein the blocks overlap by a factor of substantially ½.

19. The method of claim 17 wherein each block contains about 2048 samples.

20. The method of claim 17 wherein the window function signal is representative of a raised cosine function.

21. The method of claim 17 and further comprising zero padding each block before processing each windowed block in accordance with a fast Fourier transform.

22. The method of claim 17 further comprising processing said subband signals representative of said N output channel signals to provide time-domain representations of the output channel signals, $o_1(t), o_2(t), \ldots, o_n(t)$.

23. The method of claim 22 and further comprising processing the first subband signal representation in accordance with an inverse short-term Fourier transform to provide time-domain representations of the output channel signals, $o_1(t), o_2(t), \ldots, o_n(t)$.

24. The method of claim 1 wherein the subband-specific construction rule is chosen so that the subband representation of the output signal o(t) is the correlated portion of the input signals L(t) and R(t).

25. The method of claim 1 wherein said construction rule is of the form $o_k(t)=\alpha_k L_k(t)+\gamma_k R_k(t)$ and wherein $\alpha_k$ and $\gamma_k$ are weighting factors, the values of which depend upon k.

26. The method of claim 1 wherein said construction rule is of the form $o_k(t)=\alpha_k L_k(t)+\gamma_k R_k(t)$ and wherein $\alpha_k$ and $\gamma_k$ are weighting factors, the values of which depend upon the values of $L_k(t)$ and $R_k(t)$.

27. The method of claim 1 wherein said construction rule is of the form $o_k(t)=\alpha_k L_k(t)+\gamma_k(t)$ and wherein $\alpha_k=\gamma_k$.

28. A spatial disassembly system comprising, first and second input terminals for receiving first and second input signals L(t) and R(t) representing left and right channels of a stereo audio signal, respectively characterized by predetermined spectral balance and predetermined spatial balance, a spatial disassembly processor having a plurality of N outputs greater than two, constructed and arranged to disassemble signals on said first and second inputs including subdividing the signals on said first and second inputs into a plurality of M frequency sample subbands $L_k(t)$ and $R_k(t)$ where k is an integer ranging from 1 to M, and provide a corresponding plurality of output signals $o_1(t), o_2(t), \ldots, o_n(t)$, on said plurality of outputs derived from the frequency sample subbands of the disassembled signals according to an output construction rule $o_{j,k}(t)=f(L_k(t),R_k(t))$ for k=1, 2, . . . , M and j=1, 2, . . . , N, each of said output subband signal representations containing a plurality of output subband signal components $o_{j,k}(t)$, wherein $o_{j,k}(t)$ represents the $k^{th}$ subband output signal component of the $j^{th}$ output channel signal, wherein the output construction rule establishes the following relationship for at least some of the subband signal components $L_k(t)$ and $R_k(t)$ and output subband signal components $o_{j,k}(t)$:

$$|L_k(t)|+|R_k(t)|=\sum_{j=1}^{N}|o_{j,k}(t)|$$

and a corresponding plurality of electroacoustical transducers coupled to a respective one of said plurality of outputs for creating a sound field representative of the first and second input signals on said first and second input terminals preserving said predetermined spectral balance and said predetermined spatial balance of the first and second input signals.

29. Apparatus in accordance with claim 28 wherein said spatial disassembler includes a frequency domain spatial disassembly processor.

30. Apparatus in accordance with claim 29 wherein said spatial disassembler includes a fast Fourier transform signal processor in a signal path between an input terminal and said frequency domain spatial disassembly processor.

31. Apparatus in accordance with claim 30 and further comprising, a decomposer coupled to an input terminal for decomposing the input signal on said input terminal into overlapping blocks of sample signals, and a first window processor in the signal path between said fast Fourier transform processor and said decomposer for processing the overlapping blocks of sampled signals with a window function.

32. Apparatus in accordance with claim 31 and further comprising, an inverse fast Fourier transform processor in the signal path between said frequency domain spatial disassembly processor and an output.

33. Apparatus m accordance with claim 32 and further comprising, a second window processor in the path between said inverse fast Fourier transform processor and the latter output for processing the output of the inverse fast Fourier transform processor in accordance with a window function, a block overlapper in the path between the second window function processor and the latter output for overlapping signals provided by the second window function processor and combining the overlapped blocks to provide an output signal to an associated output terminal.

34. A method of processing a pair of input signals L(t) and R(t) representing left and right channels of a stereo audio signal, characterized by a predetermined spectral balance and predetermined spatial balance to form subband signals representative of N output channel signals $o_1(t), o_2(t), \ldots, o_n(t)$, wherein N>2 and t is time, the output channel signals to be reproduced over spatially separated loudspeakers, said method comprising:

generating a first subband signal representation of the signal L(t), said first subband signal representation containing a plurality of first subband frequency sample components $L_k(t)$ where k is an integer ranging from 1 to M;

generating a second subband signal representation of the signal R(t), said second subband signal representation containing a plurality of second subband frequency sample components $R_k(t)$; and combining said frequency sample components of the input signals L(t) and R(t) according to an output construction rule $o_{j,k}(t)=f(L_k(t),R_k(t))$ for k=1, 2, . . . , M and j=1, 2, . . . , N to provide the output subband signal representation for each of said plurality of output channel signals, each of said output subband signal representations containing a plurality of output subband signal components $o_{j,k}(t)$, wherein $o_{j,k}(t)$ represents the $k^{th}$ subband output signal component of the $j^{th}$ output channel signal, wherein the output construction rule establishes the following relationship for at least some of the subband signal components $L_k(t)$ and $R_k(t)$ and output subband signal components $o_{j,k}(t)$:

$$|L_k(t)|^2 + |R_k(t)|^2 = \sum_{j=1}^{N} |o_{j,k}(t)|^2$$

and reproducing the N output channel signals with N output speakers while preserving said predetermined spectral balance and said predetermined spatial balance of said input signals, wherein the output construction rule is subband specific, i.e., $o_{j,k}(t)=f_j(L_k(t),(R_k(t))$ for k=1, 2, . . . , M with at least two of the subbands having different steering algorithms.

* * * * *